United States Patent [19]

Ono

[11] Patent Number: 4,679,220

[45] Date of Patent: Jul. 7, 1987

[54] X-RAY TUBE DEVICE WITH A ROTATABLE ANODE

[75] Inventor: Katsuhiro Ono, Kawasaki, Japan

[73] Assignee: Kabushiki Kaisha Toshiba, Kawasaki, Japan

[21] Appl. No.: 819,822

[22] Filed: Jan. 17, 1986

[30] Foreign Application Priority Data

Jan. 23, 1985 [JP] Japan ..... 60-10470
Jun. 29, 1985 [JP] Japan ..... 60-143773

[51] Int. Cl.[4] ..... H01J 35/10

[52] U.S. Cl. ..... 378/132; 378/125; 378/126; 378/144

[58] Field of Search ..... 378/125–133, 378/143, 144

[56] References Cited

U.S. PATENT DOCUMENTS 3,855,492 12/1974 Langer et al. ..... 378/144
3,942,015 3/1976 Huxley ..... 378/144
4,081,707 3/1978 Hartl et al. .
4,162,420 7/1979 Grady ..... 378/144
4,167,671 9/1979 Boden et al. ..... 378/132
4,417,171 11/1983 Schmitmann ..... 378/144

FOREIGN PATENT DOCUMENTS 0141153 11/1981 Japan ..... 378/143

*Primary Examiner*—Craig E. Church
*Assistant Examiner*—John C. Freeman
*Attorney, Agent, or Firm*—Oblon, Fisher, Spivak, McClelland & Maier

[57] ABSTRACT

An evacuated envelope is formed with a portion of larger diameter and tubular portions extending along the axis on both sides of the portion of larger diameter in opposite directions. A target with a rotatable anode is arranged in the portion of larger diameter. A pair of shafts arranged on the tube axis and fixed on both sides of this target are arranged in the tubular portions. Each shaft has at least one flange of insulating material on the side facing the target and on its periphery is provided with a metal tube constituting a rotor of a magnetic bearing. On the outermost side of the tubular portion there are arranged a magnetic field generating device and a magnetic drive device that rotates the rotatable anode target.

15 Claims, 9 Drawing Figures

X-RAY TUBE DEVICE WITH A ROTATABLE ANODE

BACKGROUND OF THE INVENTION

This invention relates to an X-ray tube device with a rotatable anode, more particularly to a device whereby a rotatable anode target can be rotated at high speed while being supported in a non-contacting manner by magnetic bearings.

In an X-ray tube device with a rotatable anode, the target consists of a disk made of a refractory metal such as tungsten, and the X-rays are generated by making an electron beam collide with this target, whilst the target is being rotated at high speed. Rotation of the target is achieved by driving a rotor provided on a support shaft extending from the target. The support shaft is rotatably supported by means of bearings. Mechanical contact bearings have been used for this purpose. However they are liable to failure. This is because: (a) they have to support a heavy target which is rotating at high speed (at least 10,000 rpm); (b) they get very hot due to the heat from the target; and (c) they must provide support under vacuum.

Specifically, if the bearings are allowed to get hotter than 500° C., the hardness of the bearing balls decreases. This may cause tube failure produced for example by stoppage of rotation. It has also been found that there is a severe reduction in bearing life (in terms of number of rotations) when the speed of rotation is increased, if the rotor and target are rotated under vacuum. In fact bearing life is unsatisfactory at the rotational speeds currently used in X-ray tubes (about 10,000 rpm).

Moreover, if the target weight is increased in an attempt to increase its heat capacity, this also leads to a reduction in bearing life. In order to overcome this drawback, magnetic floating X-ray tubes as described in U.S. patent specification No. 4,417,171 (Schmitmann), Japanese Patent Application Publication No. Sho. 58-43860, and Japanese Patent Application Laid-open No. Sho. 59-63646 were proposed. However, these are subject to the following drawbacks. In the case of U.S. patent specification No. 4,417,171, the external diameter of the rotor becomes very large, and in addition, since the supporting pillar at the centre must be at high voltage, it is difficult to hold. In the case of Japanese Patent Application Publication No. Sho. 58-43860, the target is of low rigidity and therefore has a low resonant frequency and cannot be rotated at high speeds. In the case of Japanese Patent Application Laid-open No. Sho. 59-63646, there is the inconvenience that not only must the anode be maintained at earth potential, but also a special high voltage power source and high voltage cable are required.

SUMMARY OF THE INVENTION

An object of this invention is to obtain a highly practical X-ray tube device with a rotatable anode which has a rotating part and bearings which are of high rigidity yet to which high voltage can easily be applied, in a construction wherein and anode target that generates a large quantity of X-rays is freely rotatably supported in a non-contacting manner using magnetic bearings.

According to the invention there is provided;

an X-ray tube device with a rotatable anode equipped with:

an evacuated envelope;

a cathode which emits electrons, arranged in the evacuated envelope;

a rotatable anode target which radiates X-ray in response to bombardment by the electrons, arranged facing the cathode;

a magnetic bearing that freely rotatably supports the anode target;

a drive mechanism that drives the anode target in rotation; and means for applying voltage to the anode target through the envelope;

characterized in that it comprises;

the envelope comprising a larger diameter portion from which the X-rays are radiated and tubular portions extending from both ends thereof;

the anode target arranged in the larger diameter portion;

a pair of shafts having flanges of insulating material fixed on both sides of the anode target, extending to mutually opposite sides in the direction the tube axis, and arranged within the tubular portions in the neighbourhood of the region where they are fixed to the anode target;

a metal tube mounted at the periphery of the shafts; a magnetic field generating device that generates a magnetic field arranged on the outside of the tubular portion corresponding to the metal tube, so that, together with the metal tubes, it forms magnetic bearings;

and the drive mechanism arranged in the neighbourhood of the magnetic field generating device and outside of the tubular portion corresponding to the metal tubes, and that drives the anode target in rotation by driving the metal tubes as rotors by generating a drive magnetic field.

Due to the fact that part or the whole of the shafts are made of insulating material, the anode target is held in the bearings through insulating material. As a result, the bending stress that is produced on the shafts can be firmly supported by insulating material and high voltage can easily be applied.

DETAILED DESCRIPTION OF THE PREFERRED EMBODIMENT

Embodiments of this invention will now be described with reference to the drawings.

Figure 1:
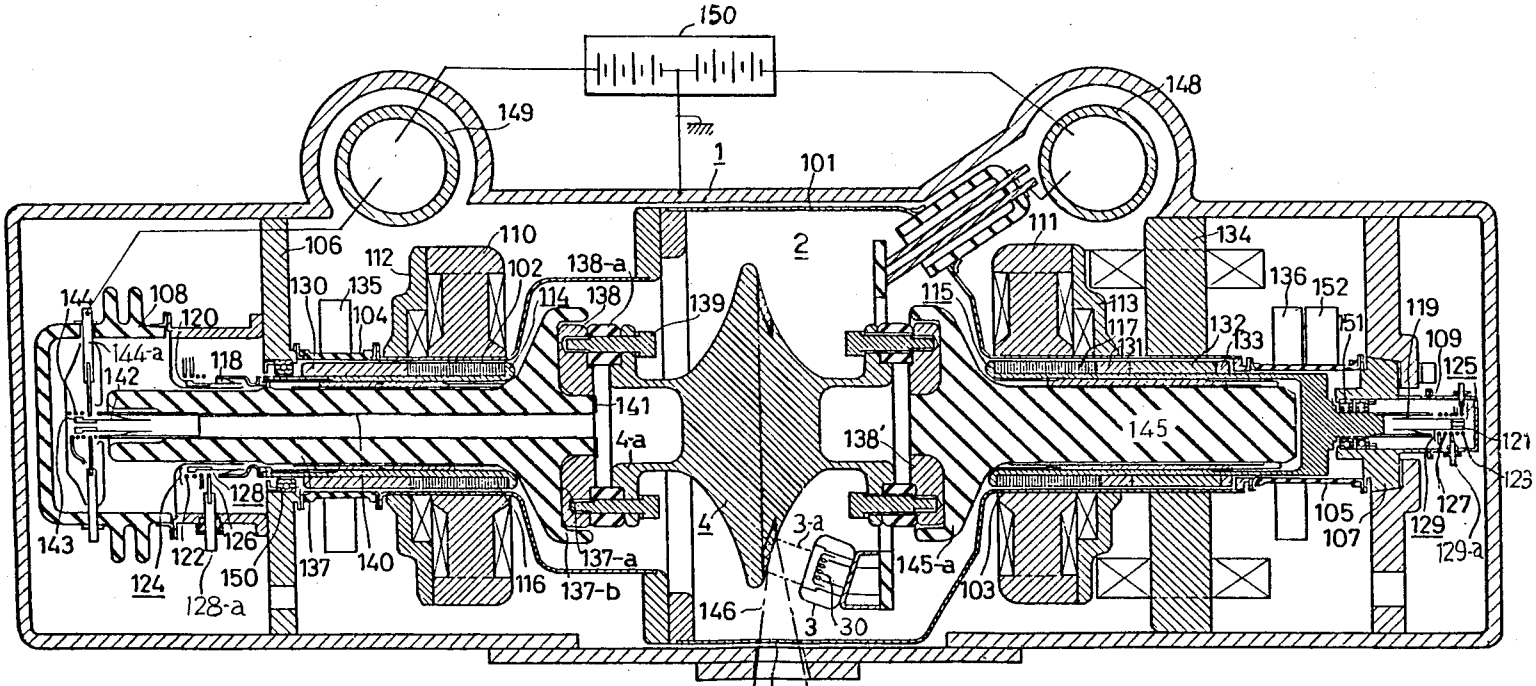
FIG. 1 is an axial cross-sectional view showing an embodiment of the invention.
Figure 2:
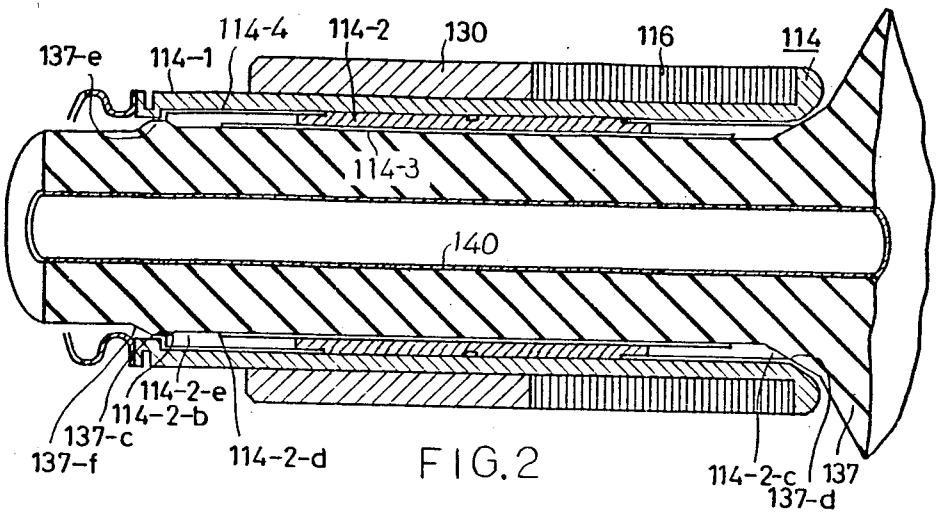
FIG. 2 is a cross-sectional view, to a larger scale, showing main parts of FIG. 1.
Figure 3:
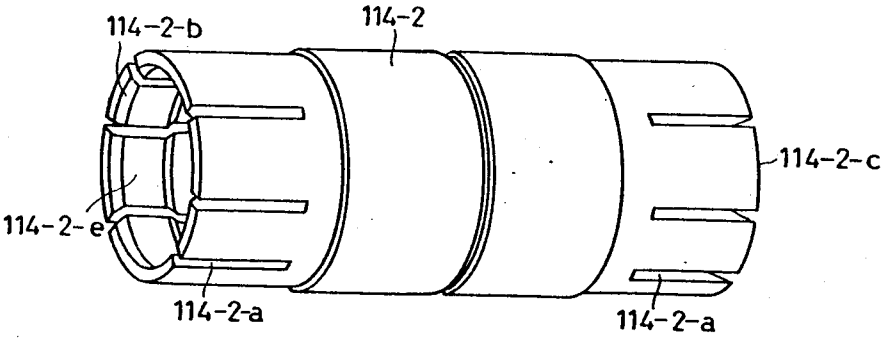
FIG. 3 is a perspective view of main parts of FIG. 1.

FIG. 1 to FIG. 3 show an embodiment of this invention. A housing 1 is made of metal and maintained at earth potential. Within housing 1 there are provided an evacuated envelope 2 comprising: a heat-absorbing container 101 of expanded shape, this container 101 accommodating a target 4 for emitting x-rays and absorbs the heat from this target.

The envelope 2 further comprises tubular portions 102, 103, vacuum partitions 104, 105, auxiliary bearing support plates 106, 107 and terminal containers 108, 109. Vacuum partitions 104, 105 are provided within position sensors and connected to the tubular portions 102, 103. The tubular portions extend from expanded portion 101 in mutually opposite directions along the tube axis. The magnetic bearings are located within tubular portions 102, 103.

Rotatable anode target 4 is disposed in the expanded portion and is of a disk shape expanded in the middle. It is, as whole, formed of a refractory metal such as molybdenum and has a ring-shaped tungsten portion embedded in its side face. This ring-shaped tungsten portion is bombarded by electrons 3-*a*.

Stators 110, 111 for serving as radial magnetic bearings generating an attractive force in the radial direction are provided outside the tubular portions of the enclosure. Stators 112,113 for seving as thrust magnetic bearings generating an attractive force in the thrust direction are provided respectively transversely of these stators 110,111 serving as radial magnetic bearings. Rotors 114, 115 for the magnetic bearings are arranged inwards of the respective stators. These rotors 114, 115 consist of metal tubes fixed at the circumference of shafts 137, 145, to be described. These rotors 114, 115 for the magnetic bearings are made of magnetic material such as pure iron. They are covered with ring-shaped sheets 116, 117 of magnetic material laminated in the form of a tube around their circumference. Attractive force is produced between these ring-shaped laminated sheets 116, 117 and the radial magnetic bearing stators 110, 111. The radial magnetic bearing is constituted by the above-described arrangement.

At respective both ends of rotors 114,115 there are bidirectional non-contacting paired diodes 124–128 and 125—129 respectively.

Figure 8:
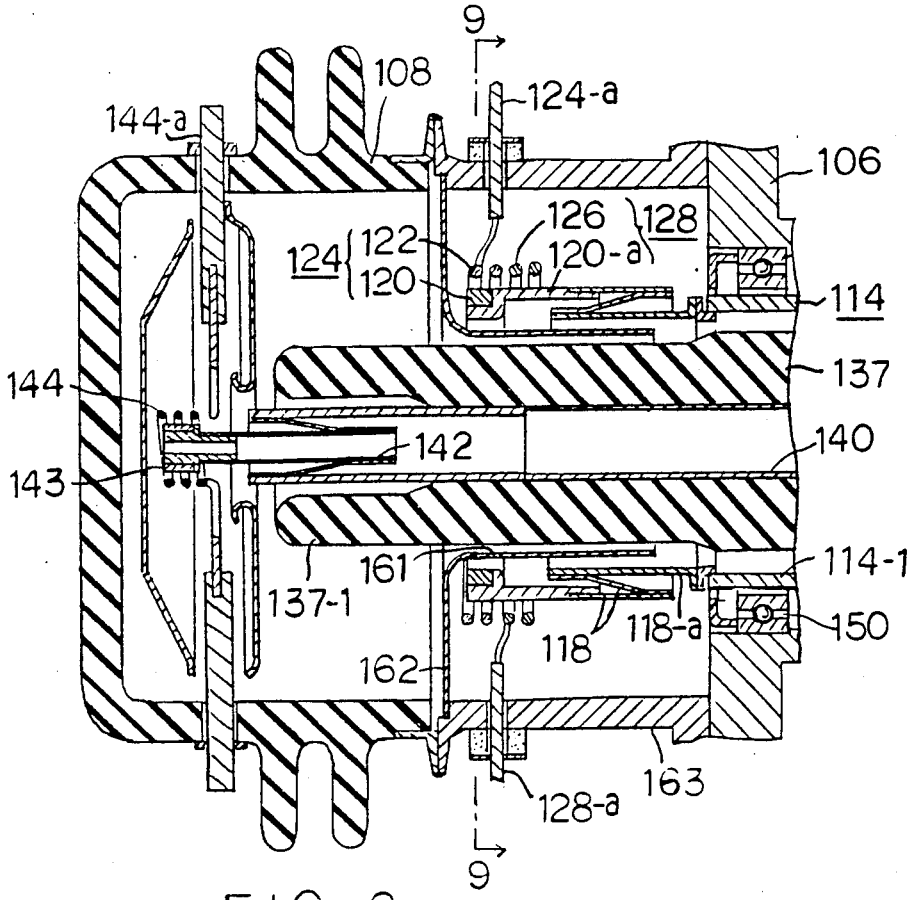
FIG. 8 is an enlarged partially sectional view of FIG. 1.
Figure 9:
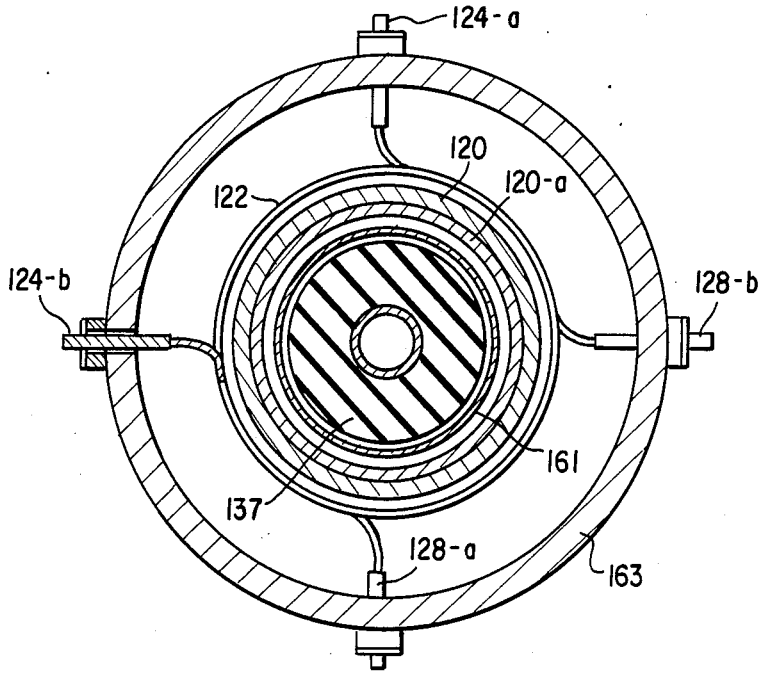
FIG. 9 is a cross-sectional view, taking the line 9—9 of FIG. 8.

In more detail, bi-directional non-contacting paired diodes 124–128 in position of rotor 114 is constructed as shown in FIGS. 1,8 and 9. There are diodes 124–128 over the circumference of a small diameter portion 137-1 extended from a shaft 137 of electrically insulating material.

A metal cylinder 118-*a* for supporting diodes 124–128 is mounted at a metal cylinder 114-1 of part of rotor 137. A heat-resistant cylinder 118 made of thin heat-resistant metal such as tantalum or of ceramics such as $Si_3N_4$ with a metallized surface is mounted on cylinder 118-*a* as coaxially folded. At the end of cylinder 118, a cylinder 120-*a* of molybdenum is fixed. Further, a ring shaped cathode 120 emitting thermal electrons at relatively low temperature such as barium-impregnated type is attached to the end periphery of cylinder 120-*a*. Outside the cathode, a coiled heater is arranged facing cathode 120. Heater 120 is supported by a pair of terminals 124-*a*,124-*b*. This heater operates for heating cathode 120 and as an anode accepting thermal electrons from cathode 120. One directional non-contacting diode 124 thus is constructed by cathode 120 rotating together with rotor 137 and heater 122 stationarily fixed, facing cathode 120. A stationary cathode 126 is coiled on the outer periphery of molybdenum cylinder portion 120-*a* closely facing cathode 120 so as to be suspended with a pair of terminals 128-*a*,128-*b*. Filament 126 operates as a cathode emitting electrons and cylinder portion 120-*a* operates as an anode.

Inverse directional non-contacting diode 128 thus comprises stationary filament 126 and cylinder portion 120*a* rotating with rotor 137. Consequently, on operation, the current passes in turn through heater 122, cathode 120, cylinder portion 120-*a* and cathode filament 126, so the metal portion positioned at the periphery of rotor 114 kept at earth or substantially earth potential.

In addition, between non-contacting paired diodes 124–128 and shaft 137 of electrical insulator, a cylinder 161 for shielding is inserted preventing shaft 137 from being deposited with evaporating metal material from the cathode and heat radiation. The flange portion 161 of cylinder 162 is fixed to a metal cylinder wall 163.

Cathode e.g., barium-impregnated cathode 121 that generate thermal electrons at relatively low temperature is mounted at the end of the magnetic bearing rotor 115 on the other side of heat-resistant cylinder 119 made of thin heat-resistant metal such as tantalum or of ceramic such as $Si_3N_4$ with a metallized surface. Diode 125 constituted by cathode 121 is formed for non-contacting current conduction between cathode 121 and heater 123. Fixed cathode 127 is provided nearby. Diode 129 of inverse conduction characteristic to the conducting diode 125 is formed between part of the rotating heat-resistant cylinder 119. The other bidirectional non-contacting diode is formed by these paired diodes 125–129. The circumferential metal members of rotor 115 is held at practically earth potential by keeping terminal 129*a* at earth or near-earth potential.

Both of magnetic bearing rotors 114, 115 are maintained at essentially earth potential by means of these diodes, so that the tubular portions 102, 103 are at essentially the same potential. By this means, the gap between them can be kept small—less than 0.5 mm—and the gap between the radial magnetic bearing stators 110, 111 and magnetic bearing rotors 114, 115 can also be kept small—less than 1 mm. As a result, a very high bearing rigidity can be achieved.

Metal rings or tubes 130, 131 made of non-magnetic metal are also fixed on the circumference of the magnetic bearing rotors 114, 115, in continuity with the laminated sheets 116, 117. Copper ring 132 and non-magnetic ring 133 are fixed at the circumference of one rotor 115 in continuity with the metal ring 131. Stator 134 for rotating the rotor is provided on the outside of the copper ring 132.

These items form an induction rotor that rotates the rotor at high speed. On the outside of the end portion of rotor there are provided radial sensors 135 and 136 on the other side of respective rings 104, 105, to detect radial displacement of magnetic bearing rotors 114, 115.

A hollow shaft 137 of electrically insulating material is rigidly mechanically fixed, by for example a shrinkage fit, on the inside of the magnetic bearing rotor 114. A metal ring 138 consisting for example of molybdenum is bonded at the end of the target side of insulating shaft 137 of rotor 114, where there is formed a flange 137-*b* of larger diameter having a wide face 137-*a* perpendicular to the axis. This bonding can be achieved for example by brazing. Thanks to this perpendicularly arranged face, a shaft construction of high rigidity can be obtained, since when bonding a uniform pressure can be applied.

End flange 4-*a* of tubular support of anode target 4 for emission of X-rays is tightly mechanically fixed to this metal ring 138 by means of bolt 139 through thermally insulating ring 138-*a* made of ceramics material or the like.

The anode target 4 comprises a disk with a maximal diameter central portion and funnel shaped side portions extending to mutually opposite sides in the direction the tube axis from the central portion, with diameters symmetrically and gradually reduced in the directions of both end flanges 4-*a*. Besides, these portions have no void. In the target structure thus constructed, rotation stress on operation is uniformly dispersed and its local concentration in the target is remarkedly relaxed, so preventing the target in rotation from damage.

Since the diameter of electrically insulating flange 137-*b* is greater in the region between the end of the magnetic bearing rotor 114 and the metal ring 138 than it is in the other regions, a high withstand voltage for example 80 kV or more can be maintained between target 4 and magnetic bearing rotor 114. In this case, flange 137-*b* of electrical insulator 137 is made to have a longer distance along its surface by bending the surface.

A thin conducting sleeve 140 is provided on the inner circumferential surface of the central bore of the electrical insulator 137. This sleeve is electrically coupled with target 4 by means of members 138 and 139 and conducting film 141 fixed by metallizing treatment to the end face of the side of electrical insulator 137 which faces target 4. Heat-resistant cylinder 142 is provided at the other end of the conducting sleeve 140 and thermal electron-emitting cathode 143 is provided in a portion thereof. Cathode 143 is heated to high temperature, about 1,000° C., by heater 144 mounted outside it. When the tube is in operation, high voltage, about 75 kV, is applied to the heater 144 from outside the tube. A low impedance electrical coupling is produced by the flow of thermal electrons referred to above from cathode 143 heated as mentioned above. The perveance of the non-contacting diode constituted by this cathode 143 and heater 144 is larger than that of the diode constituted by the cathode 3 and target 4, so the voltage drop is less to that extent. High voltage from outside the tube can therefore be supplied through bushing 149, terminal 144-*a*, diodes 143, 144 and components 142, 140, 141, 138, and 139 from power source 150 to target 4.

Another shaft 145 of electrically insulating material is inserted and shrinkage-fitted in part of the inside of the other magnetic bearing rotor 115, so that, in the same way as described above, metal plate 138 for mounting the target and rotor 115 are maintained at a high withstand voltage, for example 80 kV, by an insulating cylindrical flange 145-*a* of large diameter. Thus, as described above, rotor 115 is maintained at earth potential and target 4 is maintained at a high positive voltage. Insulating flange 145-*a* has a longer distance along its face thanks to the provision of a bent portion. Target 4 is supported on both sides between this shaft 145 and the shaft 137 so that it is positioned within a tubular region of the enclosure, which extends in mutually opposite directions along the tube axis.

A high negative voltage, for example −75 kV, is supplied to cathode 3 from outside the tube through bushing 148 through a conductor, not shown. An X-ray beam 146 is generated by collision of thermal electrons 3-*a* with target 4, which is maintained at a high positive voltage, for example +75 kV. This X-ray beam 146 is directed to outside the tube through X-ray emitting window 147 made for example of beryllium and mounted on heat-absorbing container 101. Heating voltage and high tension voltage are supplied from high tension voltage power supply 150 located outside the tube through bushing 148 to the heater 30.

On the outside of the ends of rotors 114, 115, respective auxiliary mechanical bearings 150, 151 are firmly supported by support plates 106, 107. When rotors 114 and 115 are supported by the magnetic bearings i. e. are operating normally, they are not in contact with rotors 114 and 115, but before operation is commenced, or in the case of abnormal operation, the rotary portion of the apparatus is mechanically supported by these auxiliary bearings 150, 151.

At the end of rotor 115 there is mounted a position sensor 152 to detect displacement in the thrust direction. Thrust magnetic bearing stators 112, 113 ar controlled in accordance with the output from this position sensor to control the position in the thrust direction.

Considerable mechanical strength is obtained if ceramics such as silicon nitride i.e., $Si_3N_4$ is used as the material of electrical insulator shafts 137 and 145. Since its thermal conductivity is less than that of metal, it also has the advantage of preventing the rotor becoming overheated by the heat by the heat from the target.

The method of coupling the magnetic bearing rotor 114 and electrical insulating shaft 137 will now be described with reference to FIG. 2 and FIG. 3. In the case which will be described, a ceramics material, suitably silicon nitride i.e., $Si_3N_4$ is used as the material of shaft 137.

In more detail, the metal cylinder constituted by magnetic bearing rotor 114 consists of: laminated magnetic sheets 116 described above; cylinder 130; bearing cylinder 114-1; and mechanically elastic element 114-2. Bearing cylinder 114-1 is fixed to the periphery of shaft 137 by means of mechanically elastic element 114-2.

The mechanically elastic element is made for example of titanium or pure iron and is shaped as shown in FIG. 3. Specifically, it is of cylindrical shape, provided at its end with a plurality, conveniently eight, of slits 114-2-*a*. Furthermore, an inwardly convex portion 114-2-*e* is provided on the inside of its end, contacting the outer diameter of the cylindrical electrically insulating shaft 137. The outer diameter of mechanically elastic element 114-2 is gently tapered so that it is tightly mechanically coupled with the inside diameter of bearing cylinder 114-1, which is tapered in the opposite direction. These two are then firmly fixed together for example by brazing. Tapered portions 114-2-*b* and 114-2-*c* are formed at both ends of mechanically elastic element 114-2 and tapered portions 137-*c* and 137-*d* are formed on the circumference of the electrically insulating shaft 137, so that these tapered portions are in tight mechanical contact.

In the middle of mechanically elastic element 114-2 between it and the shaft 137 there is provided a gap 114-3 of at least the difference in thermal expansion of the two. On the outer side of the portion of the mechanically elastic element 114-2 provided with the slits 114-2-*a*, between the element and the bearing cylinder 114-1, there is provided a gap 114-4 of at least the difference in thermal expansion between the element and the periphery of the shaft.

The angle of at least one of the tapered portions 137-*d*, 137-*c* is determined in accordance with the internal diameter and length of bearing rotor 114 such that it can absorb the difference in thermal expansion in the radial direction and axial direction. Also the length, number and thickness of the slits 114-2-*a* is determined such that mechanical fatigue does not occur in this region.

In assembly, the magnetic bearing rotor 114 is assembled beforehand, then it is inserted, by applying pressure at high temperature, from the outer side (direction of smaller diameter) of shaft 137. A further tapered portion 114-2-*d* is provided on the inner side of mechanically elastic element 114-2, and a tapered portion 137-*f* is provided on the outer side of projection 137-*e* of shaft 137, so that excessive resistance is not produced in the insertion process.

When the process of insertion has been completed, the portion of the mechanically elastic element 114-2 that has the slits 114-2-*a* is subject to a stress within the elastic limit and so is firmly mechanically fixed by the tapering of shaft 137.

In operation, if shaft 137 and magnetic bearing rotor 114 get very hot due to inflow of heat from the target 4, the thermal expansion of the bearing rotor 114, which is made of pure iron and is on the outside of shaft 137, will be greater than that of shaft 137, which is made of ceramics material and is on the inside of rotor 114. However, this difference in thermal expansion can be absorbed because of the respective slits 114-2-*a* at both ends of the mechanically elastic element 114-2, which act, in the mechanical sense, as beams, permitting a displacement when a suitable stress is reached. Moreover, thanks to the coupling provided by the tapering, the difference in thermal expansion in the axial direction and the extension within the elastic limit in the radial direction can be absorbed. Thus a mechanical coupling of sufficient strength can be provided from 0° to 500° C. Furthermore it can be guaranteed that there will be not adverse effects of any kind even when the assembly is rotated at 30,000 rpm, since the resonant frequency of this part can be made to be at least 1 kHz, sine it has a sufficiently large spring constant. Moreover there is little change in the rotary balance with change in temperature.

With a conventional construction, the difference in thermal expansion would correspond to 0.1 mm and the stress would reach 80 kg/mm$^2$. For this reason, it had previously been thought that it would be impossible to manufacture a rotor capable of withstanding temperatures of 500° C. because the coupling would fail by yielding of the outer metal part. However, the construction of this invention makes it possible to manufacture a rotor which is fully capable of withstanding temperatures of 500° C. or more. This in turn makes it possible to produce magnetic floating type X-ray tubes of large capacity. This had previously been thought to be impossible.

The same construction can be applied to the other bearing rotor 115 too.

In the foregoing embodiment, a non-contacting current path provided by bidirectional non-contacting diodes is used since the rotors 114 and 115 are maintained at essentially earth potential. However, a construction could be used in which one or both of these current paths is provided by mechanical contact instead. Similarly, the non-contacting diodes 143, 144 that serve to supply voltage from outside the tube to the target 4 could of course be replaced by a conducting mechanism employing mechanical contact.

Also, although the joints between target 4 and the faces of shafts 137 and 145 are by means of respective metal plates 138, they could be directly joined.

The bearing cylinder 114-1 and mechanically elastic element 114-2 could of course be integrally constructed.

Also the region of contact between the shaft 137 and mechanically elastic element 114-2 need not be merely at both ends but could be in the middle too.

Moreover the mechanically elastic element 114-2 could be composite, being divided into a number of parts.

Modified embodiments of the method of fixing the bearing rotor 114 to shaft 137 will now be described with reference to FIG. 4, FIG. 5, and FIG. 6. Those parts in these embodiments which are the same as those in the foregoing embodiment are given the same reference numerals.

In coupling insulating shaft 137 and metal tube 114, the difference in thermal expansion of these two parts produced by the heat from the target must be taken into account.

In the following embodiments, in consideration of this point, the rotors 116 and 130 are firmly fixed integrally with shaft 137.

Figure 4:
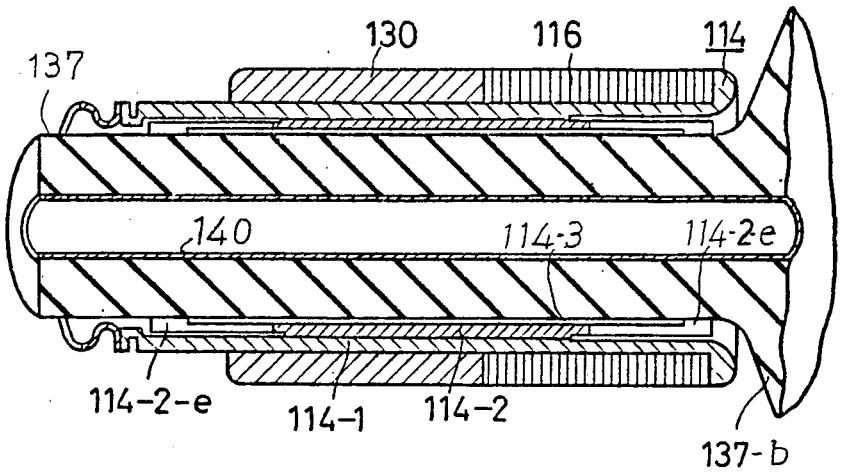
FIG. 4 to FIG. 7 are respectively cross-sectional views of further embodiments of this invention.

First of all, FIG. 4 shows an embodiment in which, instead of tapering of part of the inner diameter of mechanically elastic element 114-2, the periphery of electrically insulating shaft 137 is cylindrical, but has its leading end slightly tapered in the direction away from flange 137-*b*, and is shrinkage fitted or pressed in. One or other of the contacting parts of electrically insulating shaft 137 and the two elastic ends 14-2-*e* may conveniently be fixed by brazing or the like. The internal diameter of the middle portion of the mechanically elastic element 114-2 is larger than the outer diameter of shaft 137 so as to leave a gap 114-3 of about the difference in thermal expansion.

Figure 5:
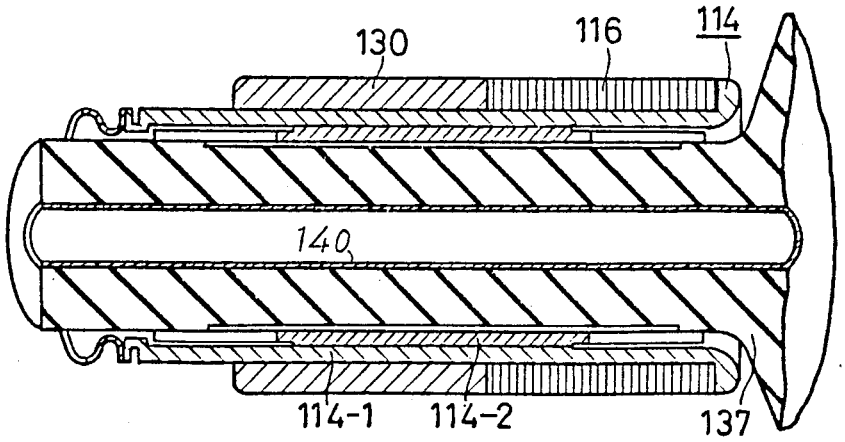

In the embodiment of FIG. 5, the inside surface of the mechanically elastic element 114-2 is cylindrical, but has a region where a portion of shaft 137 is of smaller external diameter so as to leave a gap of about the difference in thermal expansion, mechanically elastic element 114-2 being held by the elasticity between it and shaft 137.

Figure 6:
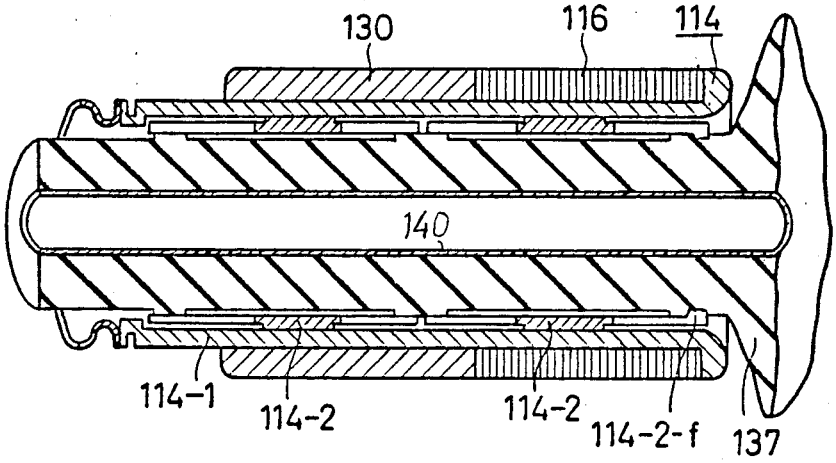

FIG. 6 shows an example in which two the mechanically elastic elements 114-2, 114-2 are used. One of these mechanically elastic elements 114-2 has a mating portion 114-2-*f* which is fitted into a recess provided on the periphery of shaft 137, so that it is prevented from movement in the axial direction also.

Figure 7:
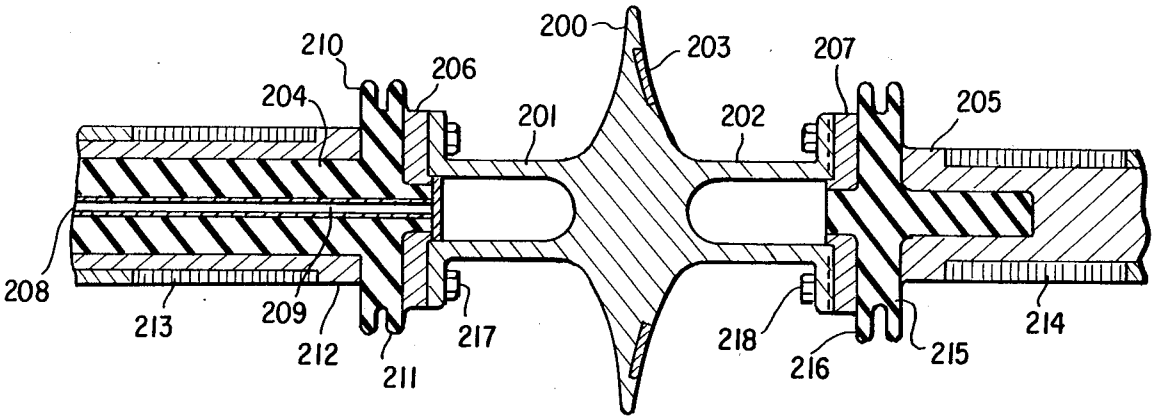

FIG. 7 shows yet a further embodiment of this invention, Wherein anode target 200 is formed in the shape of a disk with a portion of greater thickness at its centre and both side thereof. Flanged cylindrical portions 201, 202 extend in mutually opposite directions from the middle of both its side faces. As a whole, target 200 is formed of molybdenum, but a tungsten ring 203 is embedded in the side face where the electron beam is incident. These cylindrical portions 201, 202 are fixed by means of mounting metal plates 206, 207 to shafts 204, 205 extending in the axial direction of the tubular enclosure so that target 200 is freely rotatable.

One of the shafts, 204 is made of a ceramics material such as $Si_3N_4$. It is formed at its middle with a throughhole 209 provided with a metal layer 208 that constitutes the inner lead for the target. In addition it has a flange 210 of large diameter on the target side. Corrugation 211 is formed at the rim of the flange so as to increase the withstand voltage by elongating the path along the surface between rotor 213 and metal tube 212 for supporting the rotor fixed to the shaft periphery and the target 200.

In the case of the other shaft 205, the region where the rotor 214 is fixed consists of a metal element. However, the target side is constructed by a flange 215 of large diameter of ceramics material such as $Si_3N_4$. The target 200 is electrically insulated from the metal shaft portio. The rim of this flange 215 is provided with corrugation 216 that serves to increase the withstand voltage. The target-side faces of insulating flanges 210, 215 of the respective shafts have broad faces 208, 209 perpendicular to the shaft and are firmly coupled with metal mounting plates 206, 207. Finally target 200 and shafts 204, 205 are integrally fixed by screws 217, 218 to metal mounting plates 206, 207 and the flanges of cylinders 201, 202.

Formation of the perpendicular faces can be achieved by applying a high uniform pressing force when joining these faces and the metal mounting plates by brazing. Fixing can also be achieved by the bending stress produced during axial rotation. Furthermore, thanks to the use of ceramics material for the rotary shaft itself, undesired oscillations can be prevented from occurring because the mechanical resonance frequency is made high. As a result, high-speed rotation becomes possible.

The following advantages are obtained by means of this invention.

Since the rotary body is resistant to centrifugal stress, it can be rotated at ultra-high speed i.e. about 30,000 rpm. This means that the peak power loadability of the X-ray tube can be increased by a factor of 1.7 as compared with the conventional tube. Furthermore, since the rotary body is supported in a completely non-contacting manner, an X-ray tube can be provided that produces little vibration and low noise. Additionally, since mechanical ball bearings are not used, the life of the tube, in terms of number of rotations, is very long.

A high voltage power source can be used since target 4 is maintained at a high positive voltage while cathode 3 is maintained at a high negative voltage and the other components can be at a neutral point earthed potential. That is to say, a conventional X-ray tube power source can be used, so that X-ray tube with rotatable anode according to this invention can be used in a conventional X-ray generating apparatus.

Moreover, since rotors 114 and 115 are essentially at earth potential, the magnetic gap of the magnetic bearings can be made small and a high rigidity can be obtained. A very heavy (e.g. 4 kg. diameter 125 mm) target 4 therefore be rotated at ultra-high speed (for example 30,000 rpm). An ultra-large capacity (e.g. 6 MHU) X-ray tube can be constructed, if a graphite target is adopted and the rotation speed is limited at a lower level. Since rotors 114 and 115 are essentially at earth potential, the noise entering the position sensor 152 can be reduced, making possible stable operation.

The simplicity of the construction of rotors 114 and 115 also makes it possible to provide a compact low-cost X-ray tube.

I claim:

1. An X-ray tube device with a rotatable anode comprising:

an evacuated envelope;

at least one cathode which emits electrons, arranged in said evacuated envelope;

a rotatable anode target which radiates X-rays by bombardment of said electrons, arranged facing said cathode;

a magnetic bearing freely and rotatably supporting said anode target;

a drive mechanism driving said anode target in rotation; and voltage means for applying voltage to said anode target through said envelope;

the improvement comprises:

said envelope comprising a chamber portion, from which the X-rays are radiated, and tubular portions extending from both ends of the chamber portion, where the diameter of the chamber is larger than that of the tubular portions; said anode target arranged in said chamber portion;

a first shaft and a second shaft of insulating material fixed on both sides of said anode target, extending to mutually opposite sides in the direction of a tube axis, and arranged within said tubular portions in the neighborhood of the region where they are fixed to said anode target, at least one of said shafts having a conductor axially provided through said shaft and electrically coupling with the anode target;

a metal tube circumscribing said first shaft and mounted at the periphery of said first shaft, said metal tube comprising a first metal tube mounted to form a gap between it and the circumference of said first shaft, and a second metal tube provided unitary with the circumference of the first tube, constituting a rotor of said magnetic bearing, and said first metal tube comprising an elastic metal tube provided with cut-away portions at its end edges and whose two end edges elastically contact the circumference of said first shaft and a supporting metal tube which supports said rotor by fittin onto its circumference;

a magnetic field generating device containing a stator and arranged on the outside of said tubular portion corresponding to said metal tube for forming said magnetic bearing together with said metal tube; and said drive mechanism arranged in the neighborhood of said magnetic field generating device and outside of said tubular portion corresponding to said metal tube, and that drives said anode target in rotation by driving said second metal tube by generating a drive magnetic field.

2. X-ray tube device with a rotatable anode according to claim 1 wherein said anode target is disk-shaped, and the flange of said shaft is unitarily fixed at a position on the face of this disk.

3. X-ray tube device with a rotatable anode according to claim 2 wherein the joint face between the surface of the flange and the anode target is a surface perpendicular to the axial direction.

4. X-ray tube device with a rotatable anode according to claim 2 wherein said flagne is provided with a corrugation.

5. X-ray tube device with a rotatable anode according to claim 1 wherein the insulating material of said shaft is $Si_3N_4$.

6. X-ray tube device with a rotatable anode according to claim 1 wherein the magnetic field generating device of said magnetic bearing comprises a radial magnetic bearing stator that generates a force that attracts said metal tube in the radial direction of said shaft, and a thrust magnetic bearing stator that generates a force that attracts said metal tube in the thrust direction.

7. X-ray tube device with a rotatable anode according to claim 1 wherein said second metal tube is a laminated body made up of ring-shaped sheets of magnetic metal.

8. X-ray tube device with a rotatable anode according to claim 1 wherein said drive mechanism is located at a position surrounding said first shaft.

9. X-ray tube device with a rotatable anode according to claim 1 wherein the metal tube of said second shaft is provided with a thrid tube of non-magnetic metal constituting a rotor of said drive mechanism.

10. X-ray tube device with a rotatable anode according to claim 1 wherein auxiliary mechanical bearings are arranged on metal tubes of said two shafts within said enclosure, loosely surrounding them.

11. X-ray tube device with a rotatable anode according to claim 1 wherein a shaft position sensor is provided at the periphery of the tubular portion of said enclosure.

12. X-ray tube device with a rotatable anode according to claim 1 wherein there are provided first electrodes arranged at the end of the metal tubes of said two shafts on the opposite side to the target and diodes are formed with second electrodes fixed in the enclosure with a separation from these first electrodes, and the current due to thermal electrons passing between these two electrodes is electrically led out to outside the enclosure.

13. X-ray tube device with a rotatable anode according to claim 1 wherein a further electrode is provided connected to said metal layer at the end on the opposite side of said first shaft to said anode target, so as to form with another electrode fixed in the tubular portion of the enclosure, a diode, through which the thermal electron current passes.

14. X-ray tube device with a rotatable anode according to claim 13 wherein said metal tubes have earth potential applied to them.

15. X-ray tube device with a rotatable anode according to claim 1 wherein said anode target comprises a disk with a maximal diameter central portion and funnel shaped side portions extending to mutually opposite sides from said central portion.

* * * * *